US006955604B1

(12) United States Patent
Graves et al.

(10) Patent No.: US 6,955,604 B1
(45) Date of Patent: Oct. 18, 2005

(54) SYSTEM AND METHOD FOR PROVIDING A REALISTIC AUDIOVISUAL REPRESENTATION OF A GAME AMONG WIDELY SEPARATED PARTICIPANTS

(75) Inventors: Gordon T. Graves, Austin, TX (US); A. Clifford Barker, Tulsa, OK (US)

(73) Assignee: Multimedia Games, Inc., Austin, TX (US)

( * ) Notice: Subject to any disclaimer, the term of this patent is extended or adjusted under 35 U.S.C. 154(b) by 390 days.

(21) Appl. No.: 10/067,957

(22) Filed: Feb. 5, 2002

(51) Int. Cl.[7] ..... A63F 9/24
(52) U.S. Cl. ..... 463/42; 463/31; 463/18
(58) Field of Search ..... 463/1, 16–20, 463/25–30, 40–44; 434/128, 129

(56) References Cited

U.S. PATENT DOCUMENTS

| | | | | |
|---|---|---|---|---|
| 4,378,940 | A | 4/1983 | Gluz et al. | 273/237 |
| 4,760,527 | A | 7/1988 | Sidley | 364/412 |
| 4,856,787 | A | 8/1989 | Itkis | 273/237 |
| 4,875,686 | A | 10/1989 | Timms | 273/237 |
| 4,926,327 | A | 5/1990 | Sidley | 364/412 |
| 5,072,381 | A | 12/1991 | Richardson et al. | 364/410 |
| 5,242,163 | A | 9/1993 | Fulton | 273/85 |
| 5,340,119 | A | 8/1994 | Goldfarb | 273/439 |
| 5,342,047 | A | 8/1994 | Heidel et al. | 273/85 |
| 5,351,970 | A | 10/1994 | Fioretti | 273/439 |
| 5,393,057 | A | 2/1995 | Marnell, II | 273/85 |
| 5,401,024 | A | 3/1995 | Simunek | 273/138 |
| 5,411,258 | A * | 5/1995 | Wilson et al. | 463/6 |
| 5,482,289 | A | 1/1996 | Weingardt | 273/269 |
| 5,618,232 | A | 4/1997 | Martin | 463/25 |
| 5,624,119 | A | 4/1997 | Leake | 273/269 |
| 5,657,899 | A | 8/1997 | Stoken | 221/1 |
| 5,657,991 | A | 8/1997 | Camarato | 273/269 |
| 5,679,077 | A | 10/1997 | Pocock et al. | 463/19 |
| 5,830,069 | A | 11/1998 | Soltesz et al. | 463/42 |
| 5,857,911 | A | 1/1999 | Fioretti | 463/40 |
| 6,004,211 | A * | 12/1999 | Brenner et al. | 463/40 |
| 6,099,407 | A | 8/2000 | Parker, Jr. et al. | 463/19 |
| 6,186,892 | B1 | 2/2001 | Frank et al. | 463/19 |

* cited by examiner

*Primary Examiner*—Michael O'Neill
(74) *Attorney, Agent, or Firm*—Paul H. Johnson; Gable & Gotwals

(57) ABSTRACT

A method of and system of providing a realistic audiovisual representation at a remote location of a game occurring at a base location in which the base location and remote location are linked by a communications channel, including the steps of preparing a library of prerecorded video clips depicting events typically encountered in conducting a game, storing the library of the remote location, transmitting information as to the progress of a game from the base location to the remote location over the communication channel at the base location using the information to select appropriate video clips from the library that replicate the game, and presenting the selected video clips at the remote location to provide a realistic audiovisual representation.

21 Claims, 5 Drawing Sheets

SYSTEM AND METHOD FOR PROVIDING A REALISTIC AUDIOVISUAL REPRESENTATION OF A GAME AMONG WIDELY SEPARATED PARTICIPANTS

REFERENCE TO PENDING APPLICATIONS

This application is not related to any pending United States or international patent application.

REFERENCE TO MICROFICHE APPENDIX

This application is not referenced in any Microfiche Appendix.

FIELD OF THE INVENTION

The present invention relates to the use of telecommunication in conducting games of skill and chance. More particularly, one aspect of the invention is concerned with employing narrow-bandwidth telecommunication means to create a TV-quality audio and video representation of gaming events involving players at widely separated geographic sites. Such events may include real-time interaction between players and a central game host site or among different players.

BACKGROUND OF THE INVENTION

Both players and game providers benefit from linking individuals or gaming facilities at widely different geographic locations in a common game. Players can thereby compete for much larger prizes, even huge, life-changing mega-prizes, which greatly enhances the excitement and attractiveness of the game. Similarly, the increased number of players participating in each game provides larger profits for the game provider.

Prior art teaches the use of a wide area network (WAN) to permit players located at a plurality of widely separated geographic sites to play in a common game. All such approaches describe one or more two-way telecommunication links between a central host computer and each remote site.

Some systems focus on linking gaming facilities such as casinos or bingo halls. In this instance, information flows between a central game host computer and a single remote terminal located at each gaming facility. Players enroll in a game by visiting a point of sale or buying chances from a runner, who reports sales to a clerk at the remote terminal.

Other approaches envision individual players linked directly to a central game host computer; for example, using a personal computer connected to the Internet.

All such systems face a common problem; namely, how to communicate the game event to remote players in a convincing and entertaining way. Gaming is a form of entertainment; hence the challenge of remote gaming is to come as close as possible to giving the remote player the experience of being present at the live event.

In many cases, simplicity and cost considerations dictate the use of narrow bandwidth telecommunication means such as voice grade phone lines to configure the wide area network. In this case, existing techniques permit only alphanumeric data such as the numbers being drawn, cards in play, and the like to be supplied to the remote player sites. With increased bandwidth, still pictures, and with a full T1 connection or satellite link to each remote site, compressed video of the actual game event can be provided. Unfortunately, increased bandwidth also means corresponding and often unacceptable increases in system cost and complexity.

In some cases, two separate communication paths are employed, such as a narrow bandwidth bi-directional path to handle player or gaming facility interactions with the central game host, and a one-way broadband link used to broadcast real-time video of game events to remote players. While the full motion video presentation is exactly what is needed to convey a convincing and entertaining presentation of the game, the combination of a broadband communication path and a narrow-band bi-directional path is, in many cases, impractical because of the cost and equipment complexity involved.

MegaBingo, (a registered trademark Multimedia Games, Inc.) a high-stakes bingo game played continuously in Indian bingo halls for more than a decade, provides an example of the successful use of a TV link for distributing live game events. A satellite uplink is used to broadcast the live game to all participating halls. In turn, all halls are also linked by phone to the central game host for purposes of confirming card sales, receiving and verifying player claims of matching a winning pattern and other activities requiring two-way communication. To receive the MegaBingo broadcast, each hall has purchased and installed a receive-only satellite downlink terminal. While this approach conveys all of the excitement and realism of the live game to players in dozens of remote sites, it has only proven economically feasible because the tribal halls are very large and are generally open for business every night of the week.

Unfortunately, neither the direct satellite link nor other broadband means of communication is economically feasible for the thousands of charity bingo halls, even less so for individuals because of the cost and equipment complexity involved. Yet anything less than a real-time video representation of the game fails to convey the excitement and reality needed to capture and hold the player's interest.

For background information relating to the general subject matter of this invention reference may be had to the following previously issued United States patents:

| PATENT NO. | INVENTOR | TITLE |
|---|---|---|
| 4,378,940 | Gluz et al. | Electronic Device for Playing Bingo, Lotto and Allied Card Games |
| 4,760,527 | Sidley | System for Interactively Playing Poker with a Plurality of Players |
| 4,856,787 | Itkis | Concurrent Game Network |
| 4,875,686 | Timms | Electronic Bingo Games System Network and Components Therefor |
| 4,926,327 | Sidley | Computerized Gaming System |
| 5,072,381 | Richardson, et al. | Automatic Electronic Downloading of Bingo Cards with Algorithm for Generating Bingo Cards |
| 5,242,163 | Fulton | Casino Game System |
| 5,340,119 | Goldfarb | Method of Playing a Game of Chance at Locations Remote from the Game Site |
| 5,342,047 | Heidel et al. | Touch Screen Video Gaming Machine |
| 5,351,970 | Fioretti | Methods and Apparatus for Playing Bingo Over a Wide Geographic Area |
| 5,393,057 | Marnell, II | Electronic Gaming Apparatus and Method |
| 5,401,024 | Simunek | Keno Type Video Gaming Device |
| 5,482,289 | Weingardt | Method of Playing a Bingo Game with Progressive Jackpot |
| 5,618,232 | Martin | Dual Mode Gaming Device Methods and Systems |

-continued

| PATENT NO. | INVENTOR | TITLE |
|---|---|---|
| 5,624,119 | Leake | Multiple Variable Game Equipment and System for Generating Game Faces |
| 5,657,899 | Stoken | System for and Method of Dispensing Lottery Tickets |
| 5,657,991 | Camarato | Interactive Bingo-Like Games and Method of Playing |
| 5,679,077 | Pocock et al. | System and Method for Remote Participation in Bingo and Other Games of Chance Where Players Select Numbers |
| 5,830,069 | Soltesz et al. | Wide Area Networking Gaming |
| 5,857,911 | Firoetti | Methods and Apparatus for Playing Bingo Over a Wide Geographic Area |
| 6,099,407 | Parker, Jr. et al. | Progressive Bingo |
| 6,186,892 | Frank et al. | Bingo Game for Use on the Interactive Communication Network which Relies Upon Probabilities for Winning |

BRIEF SUMMARY OF THE INVENTION

The present invention takes advantage of the low cost, high-speed operation and large hard disk and random access memory capacity of today's desktop or "personal" computers. In addition, a preferred embodiment of the invention takes further advantage of the nearly universal access to the Internet by both homes and gaming facilities.

An object of the present invention is to employ low-bandwidth telecommunications to provide a realistic entertaining video presentation of games of skill and chance to players at widely different geographic locations.

A further object of the present invention is to incorporate the interaction of players into the presentation of game events. A further object of the present invention is to permit simultaneous verification of player win claims at both the central game host and the remote sites. Yet another object of the present invention is to provide a means for further enhancing the entertainment value of game presentations by the seamless insertion of animation and entertaining graphics into the presentation of game events. A further object of the present invention is to allow a single game host to conduct a plurality of independent games concurrently among a plurality of players, groups of players or gaming facilities. Yet another object of the present invention is to provide a means, using minimal computer memory, to deliver an entertaining, realistic presentation of game events for delayed presentation at the convenience of each remote gaming facility.

The present invention discloses a system and method employing a narrow bandwidth wide area network (WAN) comprising a central game host computer and a plurality of remote gaming sites playing in a common game. The network is used to provide both a two-way exchange of gaming data and an entertaining, full color, full motion representation of the game. In one embodiment, the remote sites may consist of individual players, typically using dial-up modem connections to the Internet. In another embodiment, the remote sites may consist of gaming facilities such as bingo halls or casinos. The remote sites may also consist of a mix of individual players and gaming facilities.

Each remote site is equipped with a desktop computer meeting certain minimum requirements for processor speed, random access memory, hard disk storage capacity and features such as modem, sound and video cards, and CD ROM drive as may be required to implement each remote terminal. These minimum requirements are readily determined by persons skilled in this technology.

In a preferred embodiment, remote sites are linked to the game host computer via the Internet using conventional modems and voice grade phone lines dialed up to local Internet service providers. In other embodiments, alternate telecommunication links may be used, such as frame relay or direct phone line/modem connections to the game host site.

Application software to implement the invention is resident on each remote computer, along with a library of video clips and algorithms; the latter being used to produce screen graphics and to verify wins. Codes and data messages received from the game host computer produce a seamless sequence of video clips and graphics depicting the game event. In the preferred embodiment, software is delivered to the remote sites in the form of CD ROMs. Additional software may be provided from time-to-time, either by the same means or by download from the central gaming site.

In the case of a bingo game, the sequence of balls drawn at the live game site is transmitted to each remote player site, thereby creating a simulated TV presentation of a bail caller drawing and calling each ball. The clips may take the form of actual video of a live caller drawing and calling each of the 75 possible numbers in a bingo game, or an animated character performing the same function. When a player believes he/she has matched a winning pattern, the index number on their card is sent to the central host by entering that number via the keyboard at the remote computer. The game host computer, in turn, sends the card index number to all participating player sites. Verifier software on the game host computer and all remote site computers creates an image of the player's card on all computer screens, daubed with any numbers that have been called so far in the game. If the card contains a valid match to the winning pattern, a video segment announcing the win is played. If not, a video clip announcing that the claimed match was not valid is played. In the latter case, the drawing of balls is resumed until a valid win occurs.

We briefly consider another example, that of a chess game. In this case, graphics software is used to generate images of a chessboard on each player's computer screen, showing the current position of each chess piece.

The above examples are intended to be illustrative of the invention. Numerous applications of this invention to other games involving a finite number of outcomes or games played with a finite number of different objects will be obvious to anyone skilled in the technology.

A more complete understanding of the invention will be obtained by reference to the following specification of the preferred embodiment, taken in conjunction with the attached drawings.

DETAILED DESCRIPTION OF A PREFERRED EMBODIMENT

Figure 1:
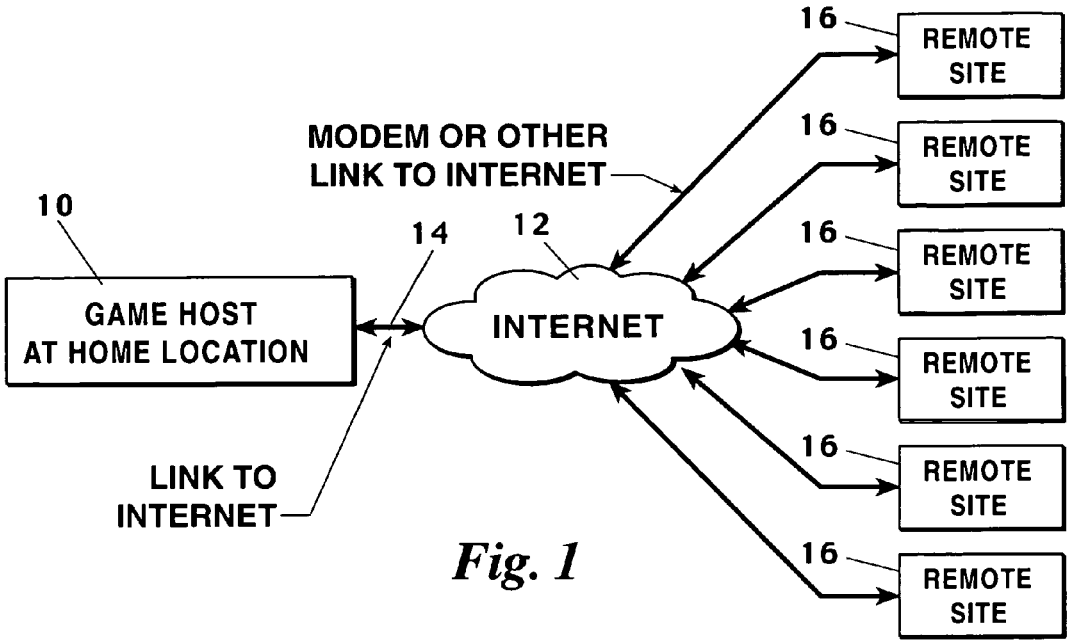
FIG. 1 depicts diagrammatically an application of the invention in which communication channels are provided by the Internet.

FIG. 1 depicts the invention when the communication system employed is the Internet. Remote locations may be either gaming facilities or individuals or both. In order to support a large number of remote locations, the game host computer 10 employs a T1 connection to the Internet. The remote game sites are connected to Internet 12 via a dial-up modem (not shown) typically capable of operation at 28.8 kilobits per second. Other means of connecting to the Internet 12 may also be used. Increasing numbers of individual Internet users have access via high-speed DSL or cable modems. Remote locations may, for example, access host computer 10 using digital frame relay, ATM (asynchronous transfer mode), or ISDN connections.

Figure 2:
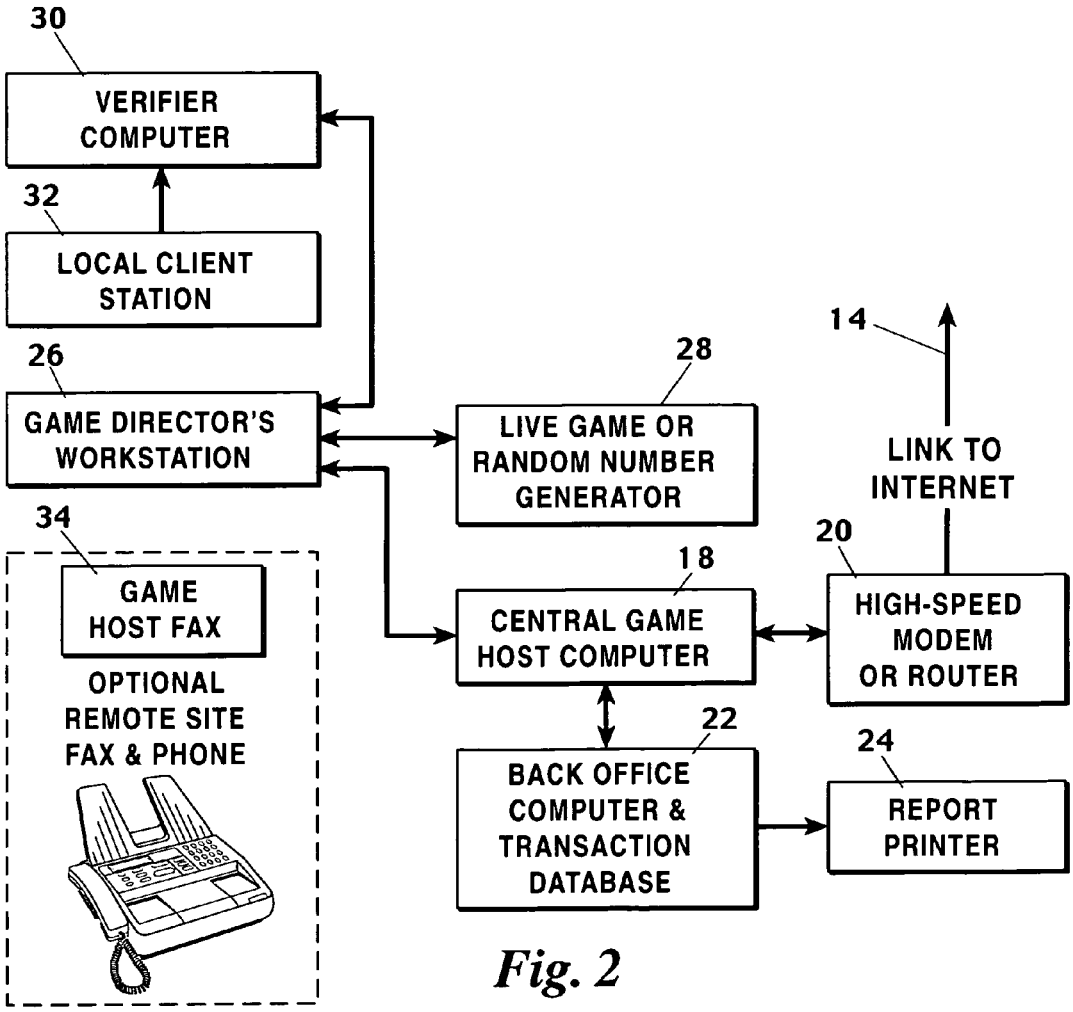
FIG. 2 is a block diagram of the equipment employed at a base location.

FIG. 2 is a block diagram representation of equipment typically employed at a base location, including a central game host computer 18; a high-speed modem or router 20 that provides connection to link 14; a back office computer 22 that includes a transaction data base; a printer 24 for providing hard copies of reports of gaming operations; a game director's workstation 26 that provides input to the central game host computer 18; a live game or a random number generator 28 that provides the variables for creating a game, the generator providing an input to workstation 26; a verifier computer 30 coupled to workstation 26 primarily required for verifying participants and winners; and a local client station 32. In addition, as an optional piece of equipment, a game host fax 34 provides a convenient way of communicating with a fax at each remote location for confirming participation winners and losers and so forth. The blocks shown represent functional elements. Certain of the functions shown may be implemented in separate computers or combined in a single machine at the option of a system designer.

During the game, verifier computer 30 typically receives inputs consisting of numbers drawn and the serial number of any claimed winning card. Using this information, it determines whether a claimed win is valid or not. In order to accomplish this, verifier computer 30 either contains a database of all the cards in play (when the game is bingo), cataloged by serial number, or an algorithm that can be used to determine the pattern on any card as a function of the serial number printed on the face of the card. In an alternate configuration, the verifier computer 30 may simply be sent the serial number of any claimed winning card and return the pattern of numbers on that card to central game host computer 18 via game director's workstation 26. In this case, the step of comparing numbers that have been called with the pattern on the claimed winning card is performed by the game host computer 18.

Live game or random number generator 28 provides the sequence of numbers used to play the game. As each number is drawn or electronically determined, it is transmitted to the game director's workstation and immediately sent via the Internet 12 (as seen in FIG. 1) to all participating remote locations.

As each number is received by a client computer at a remote location, a stored video clip is played showing the drawing of that number. Whenever a player at a remote location claims to have a winning card, a game director, upon receiving notification of this event, stops the ball call sequence until the win can be verified as described above.

Functions of the game director's workstation 26 and central game host computer 18 will typically be implemented in a single computer. Software that performs the game control functions and provides a graphical user interface for the game director resides in the central game host computer 18.

Local client station 32 is positioned adjacent to the game director's workstation 26, allowing the game director to monitor exactly what the participants at each remote site are seeing and hearing.

The back office computer 22 with its transaction database contains a log of all events that occur at the base location, including all transactions between the base location and each remote location. Information includes a log of all messages sent to or received from each remote location, such as numbers called in each game, serial numbers of all claimed winning cards, card sales, etc. It also contains software for formatting reports. The report printer 24 is used to produce hard copies of these reports, which can also be transmitted electronically as required.

Figure 3:
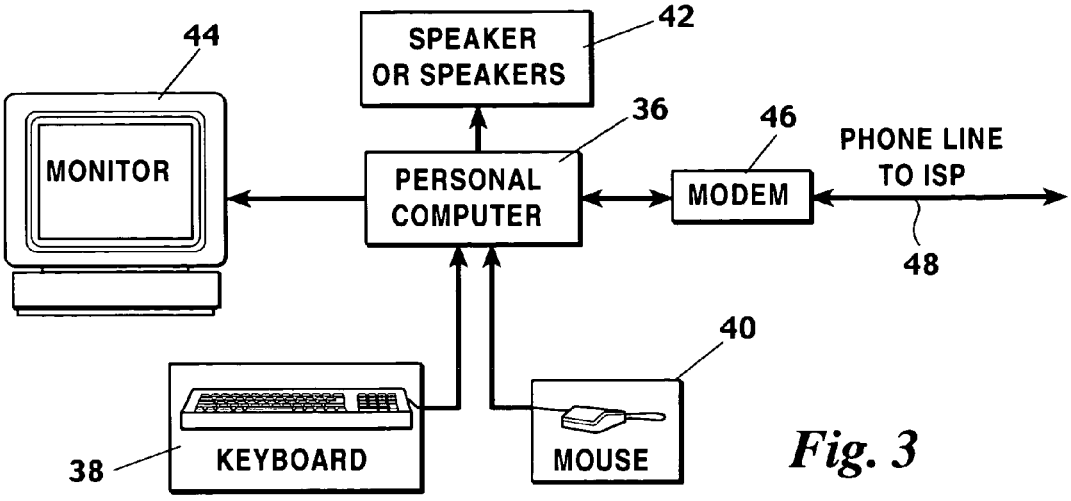
FIG. 3 is a block diagram of an individual remote player terminal.

FIG. 3 is a block diagram of an individual remote player's installation. The only equipment required is a personal computer 36 with its associated keyboard 38, mouse 40, sound card operating a speaker 42, video monitor 44, and a modem 46, by which the personal computer is coupled to a phone line 48. In other words, just the typical home computer setup, complete with access to the Internet as previously described.

To participate, the individual player will first have enrolled to become a participant by providing certain required information to the game host 10 (FIG. 1) via the Internet. He or she will then have received and installed special game software, video clips and game algorithms required to participate in the game. The required software will either be mailed to the player in the form of a CD ROM, or, if the player has wide band access to the Internet, may be downloaded. During the game, video clips corresponding to codes sent from the game host are played on the player's video monitor 44 and speaker 42.

Figure 4:
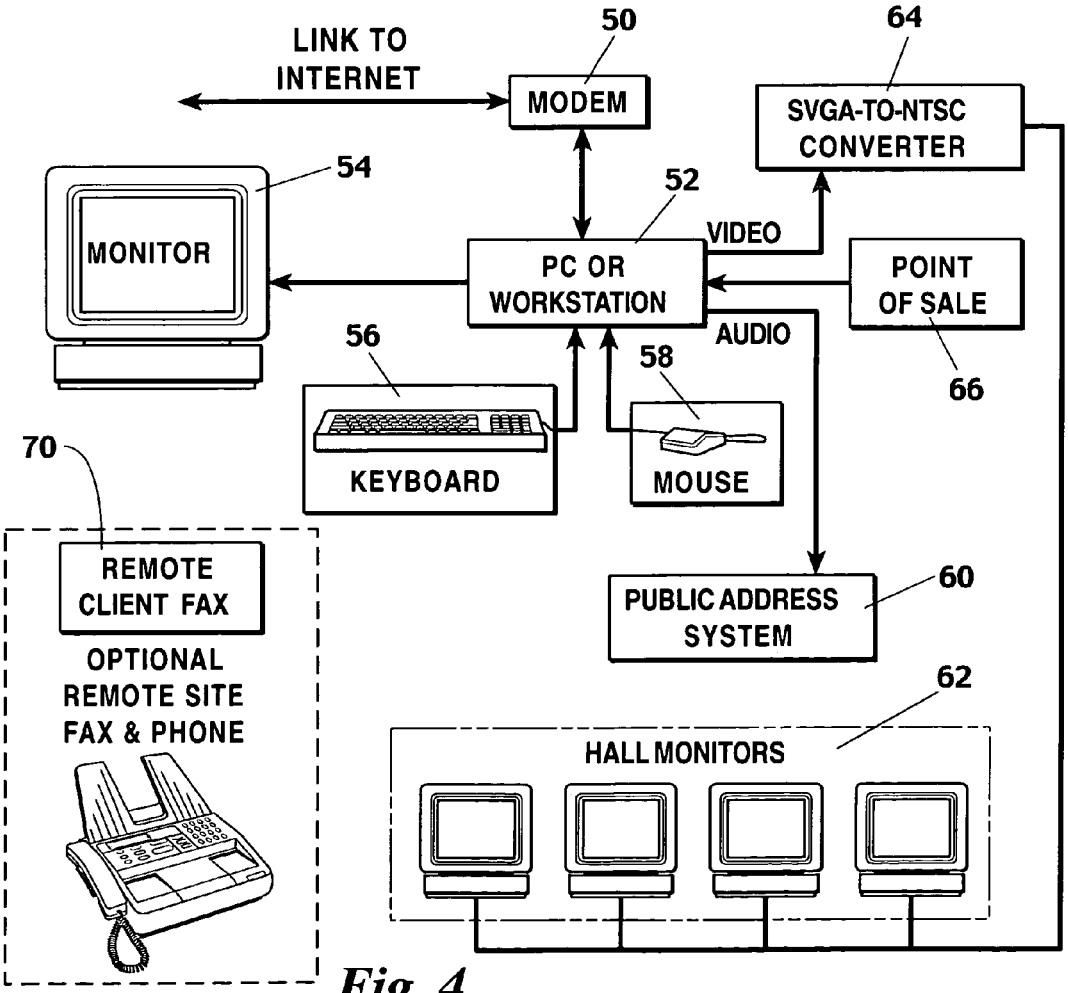
FIG. 4 is a block diagram of equipment employed wherein the remote location is a gaming facility such as a bingo hall or casino.

FIG. 4 is a block diagram depicting a typical equipment arrangement at a remote site that is a gaming facility such as a bingo hall or casino. In the embodiment shown, communication between the remote site and the game host 10 consists of a conventional modem/phone line interface 50 via an Internet service provider (ISP). As previously mentioned, examples of other methods of communicating include frame relay, ISDN or DSL links. Before the game begins, the remote terminal operator will communicate information such as the number of cards sold to the game host 10, and may also receive specific information relating to the next game, such as a video clip showing the previous night's jackpot winner.

The remote site as depicted in FIG. 4 typically includes a PC or workstation 52 with its attendant monitor 54, keyboard 56, and mouse 58 essentially as in the individual remote terminal of FIG. 3. However, when the remote site is a gaming facility, the speakers 42 of FIG. 3 are replaced with a public address system 60, and to accommodate a crowd of people, hall monitors 62 are employed driven by an appropriate SVGA-to-NTSC converter 64. At a remote site that is a gaming facility such as a bingo hall as illustrated in FIG. 4 provision is made to input information as to each individual participant as indicated by a point of sale block 66.

During a game, codes received from the game host 10 cause a sequence of video clips stored on the PC or workstation 52 at the remote site to be played in a seamless sequence. The video component of these clips is converted to standard television 62 (NTSC) format by a SVGA-to-NTSC converter 64 and sent to the hall monitors 62. The audio component is sent to a public address system 60. When a player in any gaming facility remote location declares a win, a remote terminal operator sends a code back to the game host 10 indicating that a possible win has occurred. As soon as the index number of the potential winning card can be determined, it also is sent to the game host 10 for verification as previously described. The index number is entered into a verifier computer 30 (shown in FIG. 2), which returns an array of twenty-four numbers on the corresponding card. These numbers are then transmitted to each remote location (participating hall or individual), activating an algorithm that displays the claimed winning bingo card, showing all of the numbers that have been called to that point in the game. If the card is a valid win, a video clip announcing that fact is played. If not, a corresponding clip is played and the ball sequence continues until a winning card is found.

Figure 5:
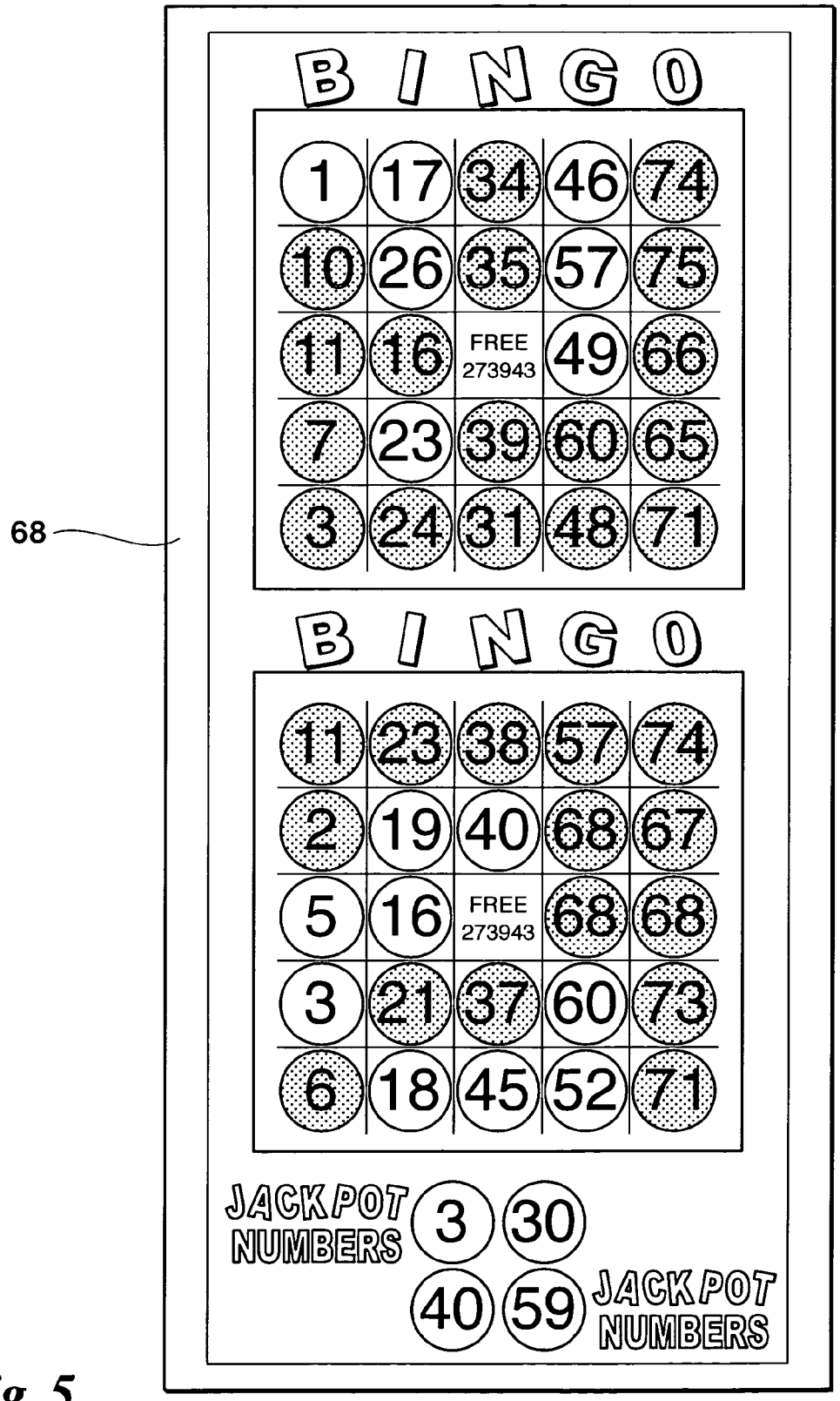
FIG. 5 illustrates a bingo card for use in a linked bingo game.

FIG. 5 illustrates an example of a bingo card used for playing a high-stakes bingo game in multiple remote sites that are linked together in a common game. The card includes two bingo "faces" and four "bonus numbers" at the bottom. In this case some of the numbers on the bingo faces are covered with shaded circles, indicating that these numbers have been "predaubed". This feature permits the game to end in fewer drawn balls, thereby producing a faster, more exciting game. FIG. 5 illustrates one of a virtually unlimited number of ways a game such as bingo may be played employing the method and system of this invention to provide a realistic representation at a remote location of a game occurring at a base location.

A typical sequence by which a realistic audiovisual representation at a remote location of a game occurring at a base location in which individual identification codes are sent from central game host computer 18 as seen in FIG. 2 to provide a game representation on hall monitors 62 and a public address system 60 as seen in FIG. 4 could, as an example, employ the following sequence:

1) Video Clip: Greeting and Introduction to the Game (explanation of winning patterns, prizes, etc.);
2) Video Clip: Call Balls;
3) Phone Bridge: One of the halls announces a "BINGO" by a player;
4) Video Clip: "We have a (another) possible winner . . . ";
5) Video Clip: Insert ad or announcement while Serial Number of possible winning card sent to Central Game Host;
6) Keyboard Entry from Remote Hall: Serial number of potential winning card sent to Central Game Host;
7) Data Transmission from Central Host to All Remote Halls: Serial number of potential winning card;
8) Algorithm: Daubed card displayed in all halls and at Central Game Host (verifier algorithm);
9) Video Clip: "We have a winner . . . " or "Sorry, no match";
10) If no match, jump to 2), etc. Otherwise, go to 11);
11) "Any more potential winners?" If yes (via phone bridge), go to 4) if no, go to 12);
12) "While tonight's winner (or winners) is going to the MegaChenko board to play for cash or an opportunity to play in our "Million Dollar Must Go" game, we will continue to draw balls for your in-hall must go prize. [Phone contact with each hall determines when enough balls have been called to have winners of all in-house prizes].
13) Video Clip: Play clip with still picture or video clip of last night's winner(s);
14) Video Clip: Explain Bonus Ball Draw, prizes, who must declare BINGO;
15) Video Clips (4): Draw and Call the four balls;
16) Video Clip: Is there a Super Bonus winner (4-spot match)?;
17) Decision: If no one claims a win, go to 20), If a win is claimed, go to 18);
18) Video Clip; "We have a (another) possible winner . . . " Repeat Steps 4), 5), and 6), then jump to 19); 19) Video Clip: "Any other super jackpot winner" If none, go to 20), Otherwise go to 18); and
20) Close (Congratulate tonight's winners, thank you for playing, join us for the next game).

Stored announcements, ads, informational comments, and so forth can be used to fill gaps in the representation.

Figure 6:
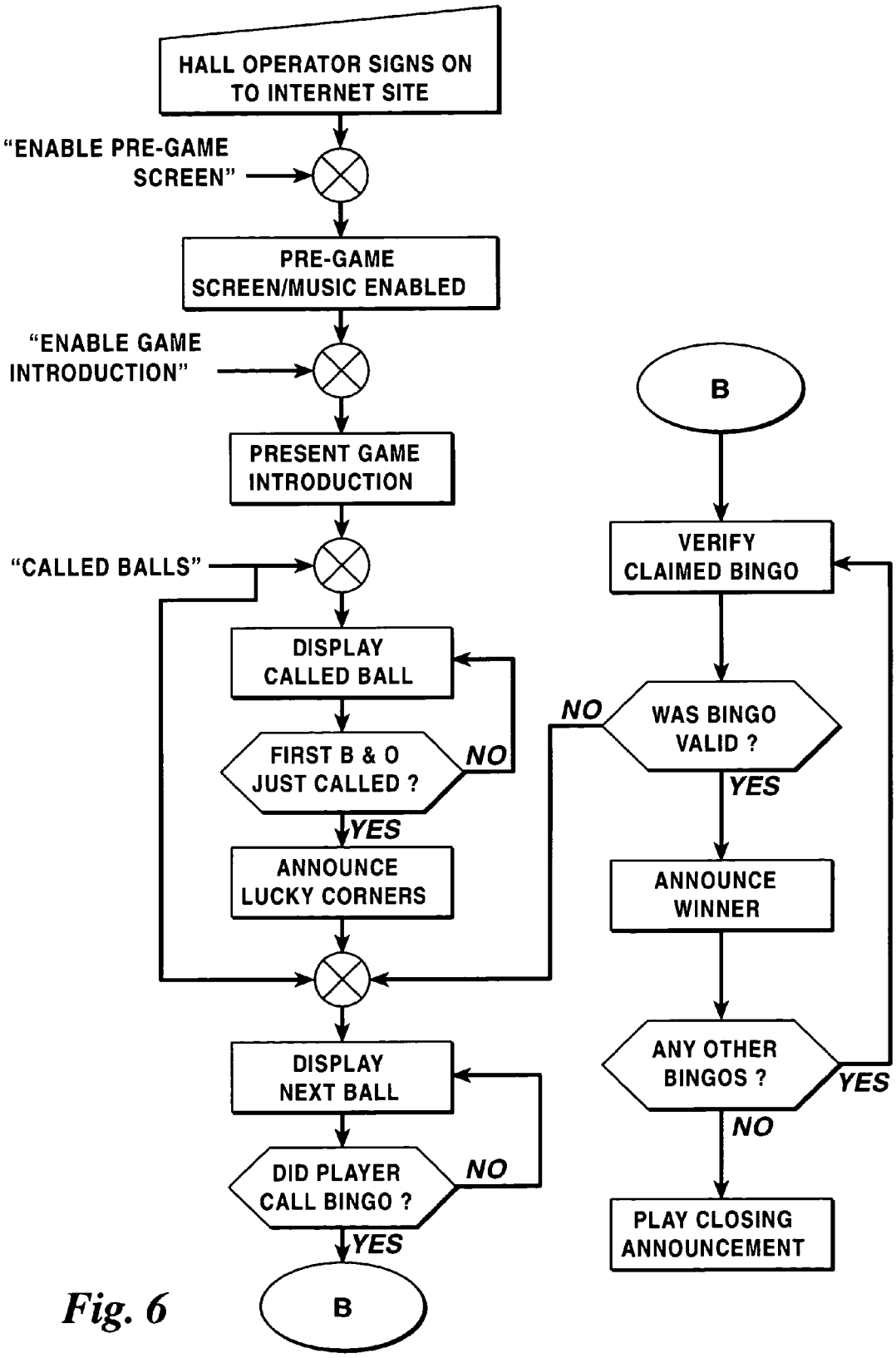
FIG. 6 is a flow chart depicting the application of the invention to a bingo game.

A flow chart of a typical game is shown in FIG. 6.

The description of the sequence of events during a typical gaming event as set forth above is in terms of a bingo game. This is done in order to provide a specific example of the functioning of the invention. A similar sequence can be readily constructed for any gaming event characterized by either a finite number of outcomes (e.g., bingo) or played with a finite number of objects (e.g., chess), and in which a game is a game of chance, a game of skill, or a game that is a combination of chance and skill.

In the case of a gambling game such as bingo, all sales of chances (e.g. bingo cards) are reported to the game host 10 by the remote sites 16 prior to the start of play. Typically, this would be done using the same Internet connection employed for producing the game show, but could be accomplished by phone or fax. FIG. 4 illustrates the use of a fax 70 for such purpose. When it is time to start the game, a game director sends codes to the participating halls causing one or more introductory video clips stored in each hall computer to be played.

During a game, balls drawn (numbers called) may originate from a live game or random number generator 28 as indicated in FIG. 2. In the case of a live game, the ball draw is typically located at one of the remote sites (bingo hall or casino), and the results are communicated by telephone (voice) to a game director as each number is drawn. The game director then enters each number via a keyboard at the game director's workstation 26, causing each number in sequence to be sent to all participants via the Internet.

Figure 7:
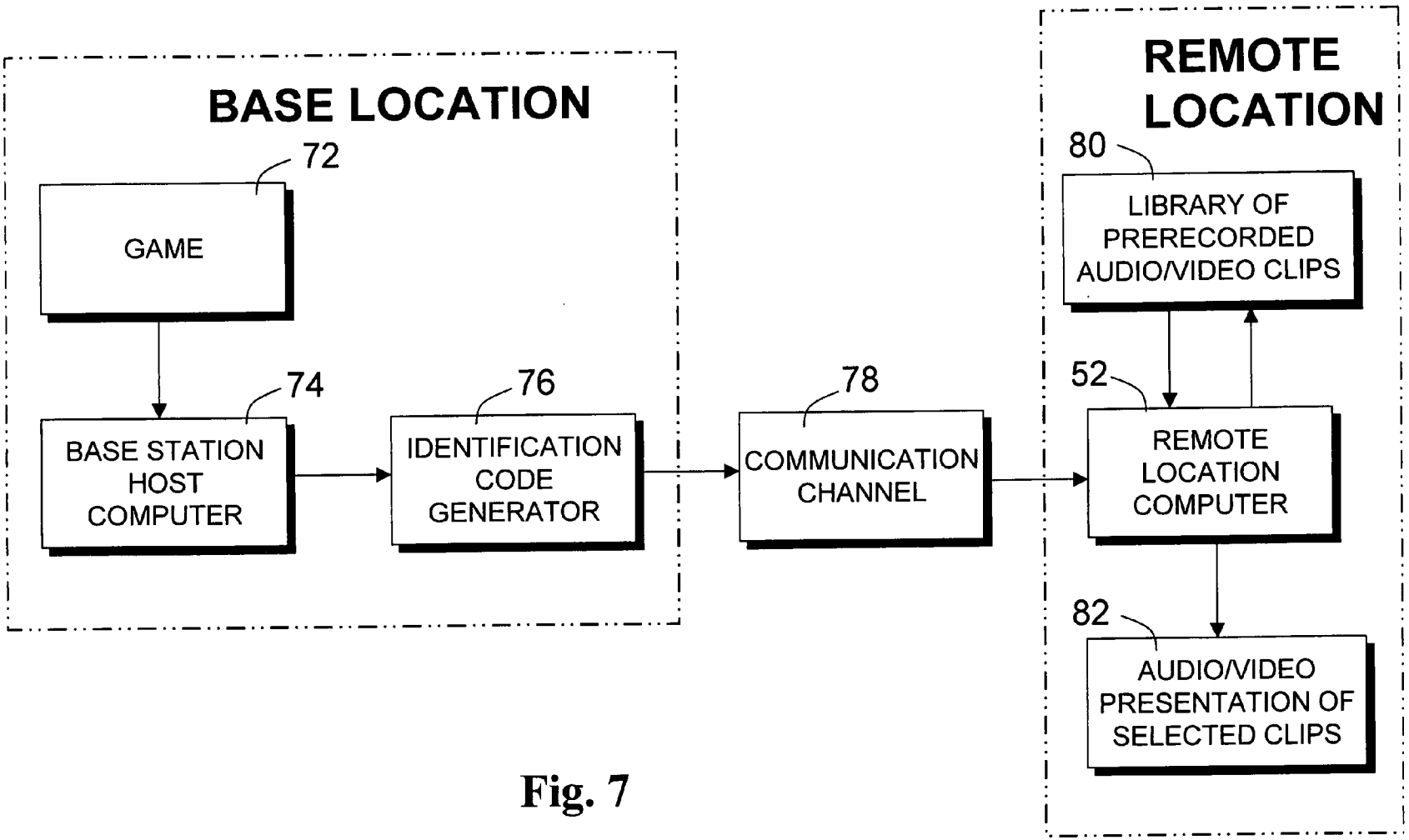
FIG. 7 is a flow chart of the basic steps of practicing the method of the invention.

FIG. 7 illustrates the basic steps for practicing the invention herein as specifically outlined in the Summary of the Invention, Specifications and the Abstract. These basic steps include playing a game which can, as an example, be a bingo game 72. The results of the game as played are fed to a base station host computer 74. The computer 74 is programmed to transmit a recreation of the game as the game takes place. From base station host computer 74 signals are transmitted to an identification code generator 76 which responds to the events of the game 72 to select appropriate audio/video clips useful in replicating the game. Signals from the base station host computer 74 and identification code generator 76 are transmitted by a communication channel 78, such as the Internet, to a remote location computer or workstation such as the PC or other computer system 52 as identified in FIG. 4. From a library of prerecorded audio/video clips 80 stored in computer 52 and called up in response to the identification codes transmitted by communication channel 78 an audio/ video replication of game 72 is formulated as indicated by 82 which is presented to a customer or potential customers such as by monitor 54 and hall monitor 62 as illustrated in FIG. 4.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A method of providing a realistic audiovisual reconstruction or emulation at a remote location of a game occurring at a base location in which the base location and remote location are linked by a communication channel in a manner to reduce the band width requirement of the communication channel, comprising the steps of:

(a) preparing a stored library of pre-recorded individual video clips comprising a finite set of possible occurrences during the progress of a game;

(b) storing said library of pre-recorded individual video clips in a computer at said remote location, each video clip being associated with an individual identification code;

(c) transmitting a sequence of individual identification codes as the game progresses from said base location to said remote location over said communication channel; and (d) at said base location, using said individual identification codes to selectably juxtapose a sequence of said individual video clips form said stored library to emulate or reconstruct said game and thereby reducing the band width required of said transmitting step.

2. A method of providing a realistic audiovisual representation according to claim 1 wherein said remote location includes a plurality of remote locations each linked to said base location by a communications channel, and in which said library of pre-recorded video clips is stored at each remote location whereby a realistic audiovisual representation of said game is replicated at each remote location.

3. A method of providing a realistic audiovisual representation according to claim 1, wherein said computer at said remote location includes algorithms for providing computer-generated visual and/or sound images relevant to said game.

4. A method of providing a realistic audiovisual representation according to claim 3 wherein appropriate video clips and/or computer generated graphical visual and/or sound replications are presented at video monitors and/or loud speakers at said remote location.

5. A method of providing a realistic audiovisual representation according to claim 1 wherein said game has been recorded and the realistic audiovisual representation is a delayed representation of a game that has already been played.

6. A method of providing a realistic audiovisual representation according to claim 1 wherein said game is a game of skill or a game of chance or a combination of skill and chance.

7. A method of providing a realistic audiovisual representation according to claim 6 in which said game involves a finite number of possible outcomes or that employs a finite number of game objects.

8. A method of providing a realistic audiovisual representation according to claim 1 wherein the remote location is a personal computer.

9. A method of providing a realistic audiovisual representation according to claim 1 in, which there are a plurality of remote locations.

10. A method of providing a realistic audiovisual representation according to claim 1 in which step (c) is accomplished using a host computer.

11. A method of providing a realistic audiovisual representation according to claim 10 wherein said game is interactive in which players' decisions are transmitted to said host computer and are, at least in some instances, instrumental in progress of the game.

12. A method of providing a realistic audiovisual representation according to claim 10 in which said host computer conducts multiple independent games simultaneously.

13. A system for providing realistic audiovisual reconstruction or emulation of a game at at least one remote location, comprising;

a host computer at a base location;

a computer system at each remote location connected to control audiovisual equipment;

a communication channel interconnecting said host computer and each said remote computer system;

a prepared library of pre-recorded individual video clips comprising a finite set of possible occurrences during the progress of a game, the library being stored in said computer system at each remote location, each individual video clip being associated with an individual identification code; and input apparatus connected to said host computer for inputting information as to progress of the game by which individual identification codes are generated, the individual identification codes being transmitted to said computer system at each remote location and used to access appropriate video clips from said library, the video clips being presented in juxtaposing sequence to thereby provide a realistic audiovisual reconstruction of said game as it occurs, thereby reducing the band width required of said communication channel.

14. A system according to claim 12 in which said computer system at each remote location includes algorithms for providing computer-generated visual and/or sound images relevant to said game.

15. A system according to claim 14 including video monitors and loud speakers at each said remote location by which said video clips and/or computer generated visual and/or sound images are presented.

16. A system according to claim 13 wherein said game is in the form of a recorded game previously played and the realistic audiovisual presentation represents a delayed representation of said recorded game.

17. A system according to claim 13 wherein said game is a game of skill or a game of chance or a combination of skill and chance.

18. A system according to claim 17 in which said game involves a finite number of possible outcomes or that employs a finite number of game objects.

19. A system according to claim 13 in which at least one of said computer systems is a personal computer.

20. A system according to claim 13 in which said game is interactive in which players' decisions are transmitted to said host computer and are, at least in some instances, instrumental in progress of the game.

21. A system according to claim 13 in which said host computer is capable of conducting multiple independent games simultaneously.

* * * * *